United States Patent [19]

Richards

[11] 4,358,123

[45] Nov. 9, 1982

[54] ATTACHMENT FOR A GROUND TRAVERSING DEVICE AND/OR A GROUND TRAVERSING DEVICE

[76] Inventor: Dean E. Richards, 752 Maioro St., Avondale, Auckland, New Zealand

[21] Appl. No.: 39,212

[22] Filed: May 15, 1979

[30] Foreign Application Priority Data

May 16, 1978 [NZ] New Zealand ..... 187294
Sep. 8, 1978 [NZ] New Zealand ..... 188378

[51] Int. Cl.[3] ..... B62B 1/00

[52] U.S. Cl. ..... 280/47.13 R; 15/49 R; 15/79 R; 15/246; 56/400.14; 56/400.15; 280/43.1; 280/47.2; 404/85

[58] Field of Search ..... 280/47.13 R, 43.1, 47.32, 280/641, 645, 43, 47.2, 8, 12 R; 15/160, 79 R, 246, 257 R, 49 R, 98, 49 C, 49 RB; 56/400.14, 400.15; 51/177, 174; 404/85, 86

[56] References Cited

U.S. PATENT DOCUMENTS

| | | | |
|---|---|---|---|
| 492,487 | 2/1893 | Reardon | 15/79 R |
| 1,525,617 | 2/1925 | Mills | 15/79 R |
| 2,348,268 | 5/1944 | Smith | 15/49 R |
| 2,415,392 | 2/1947 | Morehouse | 280/43.1 X |
| 2,515,556 | 7/1950 | Hartling | 280/43.1 X |

*Primary Examiner*—Joseph F. Peters, Jr.
*Assistant Examiner*—Milton L. Smith
*Attorney, Agent, or Firm*—Holman & Stern

[57] ABSTRACT

An attachment for a broom or similar device has a bracket engageable on the broom handle and an axle pivotally mounted on the bracket. The axle carries wheels, castors or the like and a stop is provided to limit the range of pivotal movement so that the axle can be positioned relative to the handle so that the wheels or castors either support said broom on the ground or do not support said broom on the ground.

5 Claims, 6 Drawing Figures

-A-
-B-

ATTACHMENT FOR A GROUND TRAVERSING DEVICE AND/OR A GROUND TRAVERSING DEVICE

BRIEF SUMMARY OF THE INVENTION

This invention relates to attachment for a ground traversing device and/or a ground traversing device itself.

In one aspect the invention consists in an attachment for a ground traversing device comprising a bracket engageable on a handle or the like of a ground traversing device, an axle pivotally mounted on said bracket, a roller, runner, slide, wheel, castor or the like on said axle and a stop to limit pivotal movement of said axle to a predetermined range between forward and rearward positions, the construction and arrangement providing for said attachment to be engaged on the handle of a ground traversing device in a manner such that when the axle is in the forward position said attachment supports said ground traversing device on the ground and when the axle is in the rearward position the attachment does not support the ground traversing device.

In a further aspect the invention consists in a ground traversing device comprising an operation performing head member, a handle extending from said head member, a bracket on said handle, an axle pivotally mounted on said bracket, rollers, runners, slides, wheels or the like on said axle and a stop to limit movement of said axle to a predetermined range between forward and rearward positions, the construction and arrangement being such that when the axle is in the forward position, said ground traversing device supported on the ground by said rollers, runners, slides, wheels, castors or the like but when the axle is in the rearward position the ground traversing device is not so supported.

To those skilled in the art to which this invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF SEVERAL VIEWS OF THE DRAWINGS

One preferred form of the invention and alternative embodiments thereof will now be described with reference to the accompanying drawings in which.

DETAILED DESCRIPTION

In the preferred form of the invention an attachment for a ground traversing device and/or a ground traversing device is provided as follows. The invention will be described in relation to a ground traversing device comprising a broom but it is envisaged that other devices such as racks for example could have the construction mounted thereon.

Figures 1, 2, 3, 4, 5:
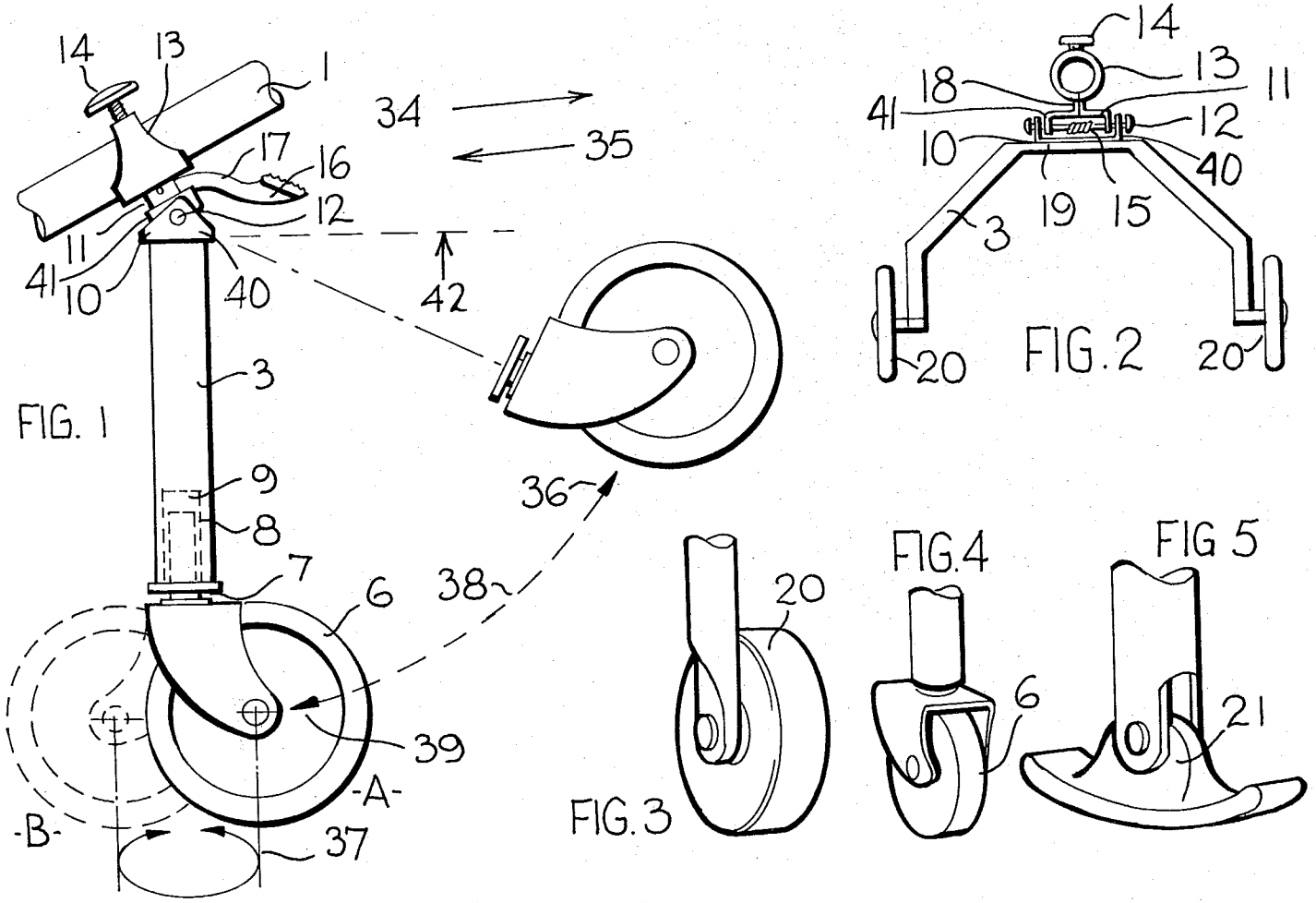
FIG. 1 is a diagrammatic perspective view of one form of a ground traversing device having an attachment thereon according to the invention.
FIG. 2 is a front elevation of one form of a ground traversing device according to the invention.
FIGS. 3,4 and 5 show alternative wheels, runners, slides or the like for use on a ground traversing device according to the invention.

Referring to FIG. 1, the ground traversing device comprises a broom having a handle 1 which has a head member 2 (see FIG. 6) thereon which is movable across the ground. The head member 2 in such a case is a sweeping head. The handle 1 carries a substantially U-shaped axle 3. At the end of each arm of the axle is provided a wheel 6, the wheel 6 may be in the form of a castor having a shaft at 7 which enters into a hollow recess 8 in the end of the arm of the U-shaped member 3, being supported for example on a ball bearing 9 or the like fixed in the aperture in the arm.

The U-shaped axle 3 is pivotally mounted to the handle 1 and this may be achieved, for example, by providing a pair of preferably substantially square bottom U-shaped brackets 10 and 11 which are pivotally affixed one to the other by a pivot pin 12 passing for example through aligned apertures in the arms or ears, 20 and 41 of the bracket. One bracket, for example, the bracket 11, is preferably positioned inside the bracket 10 but they are arranged so that the mouths of the brackets are inwardly facing one to the other. The base of the bracket 10 should have a reasonable width i.e. in the longitudinal direction of the handle 1 and the arms, at least of the bracket 11, should have a similar width, there being a gap 19 between the arms of the bracket 11 and the base of the brackets 10. The brackets 11 have means thereon to mount the construction on the handle, such as ring 13 which may be fixed, for example, by clamping screw 14, passing therethrough.

Thus in this construction a stop is formed by engagement in particular of the arms of the brackets 11 with the base of the brackets 10, that is to say, as the bracket 11 pivots with respect to the brackets 10, the arms of the bracket 11 will ultimately bear on the base 10 due to the width of these members.

The biassing means in this construction may comprise a coil or leaf, preferably a coil spring 15, wound for example around the pivot pin 12 and having arms which bear on the bases of the brackets 10 and 11 so that the spring urges the pivoting of the bracket 10 in a clockwise direction, or the pivoting of bracket 11 counterclockwise direction (Refer FIG. 1) whereby movement of the wheels 6 rearwardly will compress the spring 15 the axles 3 which will then urge to the position shown in FIG. 1 i.e. in a clockwise direction when pressure on the wheels is released.

A lock to hold the axle 3 at a desired angle to the handle 1 may be provided and one method of achieving this is to provide a pedal 16 (FIG. 1) on the outer end of a lever 17, the inner end of which has an aperture therein through which axle 12 passes. By providing a thickened portion on lever 17 either by enlarging the thickness of the lever or by twisting the material, preferably metal, at that point a downward pressure on pedal 16 will spread the spacing arms 18 between ring 13 and bracket 11. If the bracket 11 is formed as extensions of the arms 41 18 this will spread the bracket 11 and the arms thereon will clamp onto the arms 40 of bracket 10. The gap between these arms is exaggerated in FIG. 2 for clarity.

Of course the castor 6 may be replaced for example by wheels 20 or runners or slides 21 or other devices such as rollers if desired.

Figure 6:
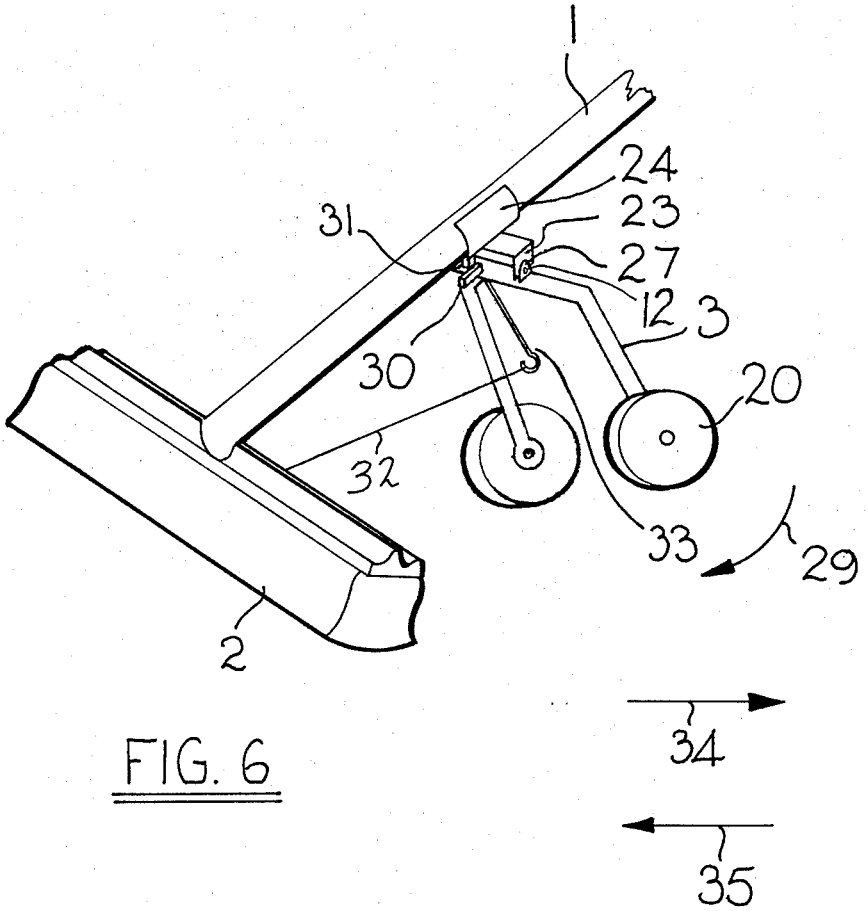
FIG. 6 is a diagrammatic perspective view of an alternative form of a ground traversing device having an attachment thereon according to the invention.

Referring to FIG. 6 a bracket 23 is provided which is for example, a substantially square bottomed U-shaped bracket and this is engaged with the handle 1, for example, by fixing a channel member 24 onto the bracket 23 and then engaging the channel member 24 onto the handle 1 for example, by a clamping screw passing through apertures in the channel member 24 into the handle 1 or by adhesive or in any other suitable manner. Pivotally mounted on the bracket 23 is an axle for example and preferably a substantially U-shaped axle 3' which has wheels 20, or castors, runners or rollers mounted on the free ends of the arms thereof.

The pivoting action may be provided by forming a pair of lugs on the axle 3' for example, lugs 27 and passing a pivot 12, through the arms of the bracket 23 and also through the lugs 27.

A stop is provided to prevent or at least substantially prevent movement of the axle 3' in particular, beyond a predetermined position in the direction of arrow 29.

The stop may comprise a tab 30 extending outwardly from the base of the U-shaped axle 3' so that the tab is for example, substantially perpendicular to the longitudinal axis of the base of the U-shaped axle 3'.

A bar 31 is provided which is preferably affixed to the channel member 24 for example, by providing a rolled or otherwise formed hollow passage on one end of the bar 31 and providing tabs on the channel member 24 so that a pivot may be passed through the tabs and the hollow passage to fix the bar onto the channel member 24.

An alternative biassing means to urge the axle 3' substantially into the position shown in FIG. 5 may also be provided so that the bar 31 is normally engaged on the tab 30 and to this end the biassing means may comprise a spring or elastic member 32 which is preferably of a relatively low tension engaged between, for example, handle 1, or head member 2, and an arm 33 extending either from the tab or preferably from the base of the U-shaped axle in a direction substantially parallel to the arms of the axle 3'.

The use of the invention is as follows:

With the construction in the position shown in FIG. 1*a* movement of the broom in the direction of arrow 34 will cause the head 2 to be lifted clear of the ground across which it is traversing and the ground traversing member i.e. the broom may be withdrawn.

When a forward sweeping motion i.e. movement in the direction of arrow 35 is provided the castors 6 will rotate to the position A in FIG. 1 and the axles 3 will rotate counterclockwise about the pivot pin 12 towards the position indicated by arrow head 36. This will compress the spring 15 and will also draw the stop away from engagement. When the broom, for example, is withdrawn the spring 15 will assist in returning the axles 3 to the original position and the castors will rotate as indicated by arrow 37 to be in the position indicated at B. Thus the arrow 38 indicates the range of operation for normal sweeping. When the castors 6 are at the mid-point of their rotation shown by arrow 37 the castor wheels 6 are outwardly directed and this causes a locking position which causes the axle 3 to be assisted in its drop into the position indicated by arrow head 39.

If it is desired to sweep in the reverse direction further forward motion of the broom will push the axle 3 into the position indicated by line 42 and with the wheels in this position a reverse sweeping action of the broom is possible.

The lock described enables the axle to be locked in any desired position and when locked so that the stop is engaged, rearward sweeping for example, may be effected by varying the attitude of handle 1.

The embodiment in FIG. 6 works similarly when the broom is moved in the direction of arrow 34 the forces on the wheels 20 will be such that the axle 3' will pivot about the pivot pin 12' and the tab 30 will move away from the bar 11. The wheels 20 will pass towards the rear and of the handle 1 and the head member may be re-engaged with the ground and a sweeping action may then take place.

The normal attitude of the broom for example will cause the bar 31 to hang in a direction whereupon when movement is again in the direction of the arrow 34, and the wheels return towards the position shown in FIG. 6, the tab 30 will again be engaged by the bar 31.

Should it be desired to fold the wheels completely forwardly the bar 31 can be withdrawn for example by hand or by a flicking motion of the broom to enable this to happen.

Thus it can be seen that an attachment for a ground traversing device and/or a ground traversing device is provided which at least in the preferred form of the invention has some advantages.

In particular, a sweeping action can be gained without the necessity of lifting the ground traversing device such as a broom from the ground on which it is engaged. It is believed that the physical effort that will be required for the movements to operate this device will be substantially less than that required for use of a conventional broom.

Also, the construction allows a sweeping action of substantial length to be obtained which is advantageous over present brooms and as the broom need not be lifted the width of broom may be substantially increased. Widths up to 20 feet are envisaged.

I claim:

1. An attachment for a ground traversing device comprising a bracket engageable on a handle of a ground traversing device, a substantially U-shaped axle pivotally mounted at its central portion on said bracket with the arms of the U-shaped axle depending therefrom, roller means mounted on the free ends of the arms of said axle to engage the ground, stop means to limit pivotal movement of said axle to a range between forward and rearward positions, said stop means comprising a pair of substantially U-shaped brackets each formed by a base and two spaced arms extending from said base pivotally affixed one to the other by a pivot pin extending through aligned apertures in said bracket arms and arranged so that pivoting of one bracket relative to the other is limited by engagement of at least one arm of one bracket with the base of the other said bracket, one of said brackets having said axle mounted thereon and the other said bracket being mountable on said handle, and biasing means to resiliently urge said axle into said forward position, said attachment being engageable on said handle so that when said axle is in said forward position said attachment supports said ground traversing device on the ground and when said axle is in said rearward position said attachment does not support said ground traversing device and means to releasably retain said axle in any position between said forward and rearward position.

2. An attachment as claimed in claim 1 wherein said biasing means comprises a coil spring operatively supported on said axle between said U-shaped brackets.

3. An attachment for a ground traversing device comprising a bracket engageable on a handle of a ground traversing device, a substantially U-shaped axle pivotally mounted at its central portion on said bracket with the arms of the U-shaped axle depending therefrom, roller means mounted on the free ends of the arms of said axle to engage the ground, stop means to limit pivotal movement of said axle to a range between forward and rearward positions, said stop means comprising a tab extending substantially perpendicularly to the plane of the two arms of and from the central portion of said axle, and a bar affixed to said bracket so that the free end of said bar engages said tab in said forward position, and biasing means to resiliently urge said axle into said forward position, said attachment being engageable on said handle so that when said axle is in said forward position said attachment supports said ground traversing device on the ground and when said axle is in said rearward position said attachment does not support said ground traversing device and means to releasably retain said axle in any position between said forward and rearward position.

4. An attachment as claimed in claim 3 wherein a spring connecting arm is provided on the base of said U-shaped axle positioned between the arms of said axle, said biassing means comprising an elastic member connected at its ends to said spring connecting arm and said ground traversing member.

5. An attachment as claimed in claim 4 wherein said biassing means has a relatively low tension.

* * * * *